US006082024A

United States Patent [19]

Del Biondi

[11] Patent Number: 6,082,024

[45] Date of Patent: Jul. 4, 2000

[54] SOLE FOR FOOTWEAR

[75] Inventor: Alberto Del Biondi, Padua, Italy

[73] Assignee: D.B.A. S.r.l., Padua, Italy

[21] Appl. No.: 09/155,476

[22] PCT Filed: Feb. 18, 1997

[86] PCT No.: PCT/EP97/00758

§ 371 Date: Nov. 27, 1998

§ 102(e) Date: Nov. 27, 1998

[87] PCT Pub. No.: WO97/36508

PCT Pub. Date: Oct. 9, 1997

[30] Foreign Application Priority Data

Mar. 29, 1996 [IT] Italy ..... PD96A0079

[51] Int. Cl.[7] ..... A43B 13/18

[52] U.S. Cl. ..... 36/28; 36/35 R; 36/32 R; 36/59 C

[58] Field of Search ..... 36/28, 35 R, 59 C, 36/59 A, 59 R, 30 R, 32 R, 61, 67 D, 141

[56] References Cited

U.S. PATENT DOCUMENTS

| | | | |
|---|---|---|---|
| 3,722,113 | 3/1973 | Birkenstock | 36/141 |
| 3,757,774 | 9/1973 | Hatuno | 36/141 |
| 4,033,054 | 7/1977 | Fukuoka | 36/141 |
| 4,109,661 | 8/1978 | Fukuoka . | |
| 4,841,647 | 6/1989 | Turucz | 36/141 |
| 4,982,737 | 1/1991 | Guttmann . | |
| 5,067,256 | 11/1991 | Darby . | |
| 5,551,173 | 9/1996 | Chambers | 36/141 |
| 5,682,690 | 11/1997 | Chang | 36/141 |
| 5,768,802 | 6/1998 | Bramani | 36/28 |
| 5,860,229 | 1/1999 | Morgenstern | 36/141 |

FOREIGN PATENT DOCUMENTS 0706767 of 1996 European Pat. Off. .

*Primary Examiner*—Paul T. Sewell
*Assistant Examiner*—J. Mohandesi
*Attorney, Agent, or Firm*—Sughrue, Mion, Zinn, Macpeak & Seas, PLLC

[57] ABSTRACT

A sole for footwear comprises an outer sole (12; 22; 31) housing a plurality of pressure-stimulation elements (15; 24; 33) movable perpendicularly, relative to the bearing surface of the outer sole, through the thickness of the outer sole and, in the absence of stresses, extending below the bearing surface of the outer sole by a predetermined distance in order, when the sole is pressed against a bearing surface, to exert, through a resilient intermediate element (17; 27; 35) comprising a soft inner sole of the footwear, a pressure localized at predetermined nerve centers in the sole of a foot on which the therapeutic footwear is worn.

9 Claims, 2 Drawing Sheets

SOLE FOR FOOTWEAR

TECHNICAL FIELD

The present invention relates to a sole for therapeutic footwear with elements for the selective stimulation of nerve centres in the sole of the foot by pressure.

BACKGROUND ART

Specialized sports footwear intended specifically for fulfilling particular requirements characteristic of various sports activities (skiing, football, tennis, various specialized kinds of running, rock-climbing, etc.) is known.

Orthopaedic footwear shaped for correcting defective walking and defects of the foot and of the lower limbs in general is also known.

Furthermore, it is known that, as well as protecting the foot and ensuring a suitable distribution of the load on the sole of the foot irrespective of roughness and unevenness of the supporting ground, combined with comfort and support in use, suitably formed footwear can also perform a useful massage function with a therapeutic effect, stimulating circulation, improving muscle tone and mobilizing stiffened joints.

Moreover, it is known that massage also has an indirect effect which may be manifested by means of nervous reflexes at a distance from the region treated in the form of more or less long-lasting vaso-motorial reactions, according to the location of the stimulation surface, its extent, and the type of stimulation.

In general, it is known that massage, whether performed manually or by suitable equipment, produces stresses of various kinds such as rubbing, repeated impacts, kneading, vibration, and even local puncture, this latter technique being known as acupuncture or Chinese massage.

For a brief but effective and exhaustive description of the various forms of massage and of its therapeutic use, reference may be made to the term "MASSAGGIO" (MASSAGE) on pp. 170, 173, Vol. III of the Enciclopedia medica per tutti (Medical Encyclopaedia for all)—Istituto Geografico De Agostini, 1969.

Implementation of the various massage techniques which, in order to be effective, have to be repeated over time in accordance with suitable programmes, requires a specific competence and the support of specialized practitioners.

Treatment is therefore expensive and demanding and, both for reasons of cost and because of the personal commitment required, is not easily accessible to a large public.

DISCLOSURE OF THE INVENTION

The present invention remedies these limitations and offers a therapeutic tool which is safe to use, is of reasonable cost, does not require particular commitment, and is compatible with the user's normal activities, and which consists of footwear having a sole which can bring about selective, repeatedly-exerted pressure stimulation, comparable to the impact massage technique, of predetermined nerve centres in the sole of the foot with therapeutic effects on other parts of the organism these effects being determined by the extent, the shape and the position of stimulation elements on the bearing surface of the sole of the foot, the stimulation elements being housed in the sole of the footwear and movable perpendicularly relative to the plane thereof, in order to exert pressure on selected areas of the sole of the foot through an inner sole.

BRIEF DESCRIPTION OF THE DRAWINGS

The characteristics and advantages of the present invention will become clearer from the following description of a preferred embodiment and of variants thereof, given with reference to the appended drawings, in which.

BEST MODE OF CARRYING OUT THE INVENTION

Figure 1:
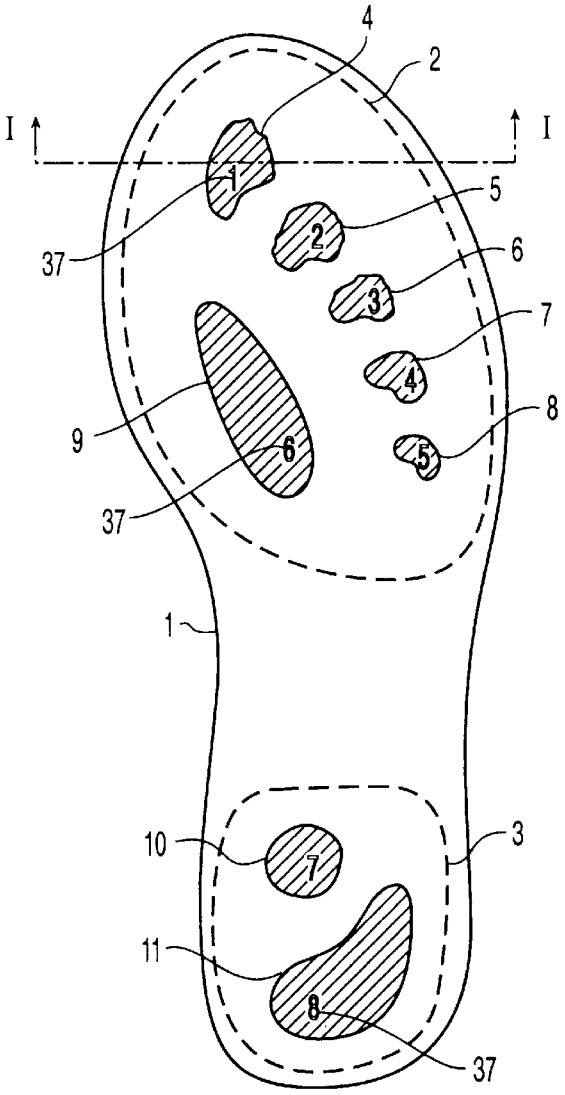
FIG. 1 shows qualitatively the sole of the left foot and the arrangement therein of stimulation zones which activate the functions of predetermined organs of the human body.

With reference to FIG. 1, which represents the sole 1 of the left foot, it is known that pressure exerted by the foot on the ground or on the insole of footwear is distributed essentially in two areas of the surface of the sole of the foot, a front area 2 corresponding to the front ends of the metatarsals and the phalanges, and a rear area 3 or heel, respectively.

Nerve centres, the periodically-repeated pressure-stimulation of which causes reflexes in various organs, stimulating their activity and efficiency, are located in these areas.

For example, the area 4 corresponds to a pressure-stimulation point which activates the circulation and has beneficial effects on the mobility of the cervical vertebrae.

Similarly, the areas 5, 6, 7, 8, and 9 are stimulation points which benefit the sight, hearing, liver, stomach and lung functions, respectively.

Similarly, in the heel, the areas 10 and 11 are specific stimulation points which benefit joint mobility in the foot and in the legs, respectively, and associated muscle tone.

In order to bring about this stimulation mechanically without the need for physiotherapeutic massages, the present invention provides a sole for footwear which can easily be integrated with an upper to form footwear with therapeutic properties, and which applies pressure stimulation in predetermined areas each time the weight of the body bears on the sole, for example, for each step.

According to the rate of change of the force exerted on the sole, the pressure applied may also assume the nature of an impact.

Figure 2:
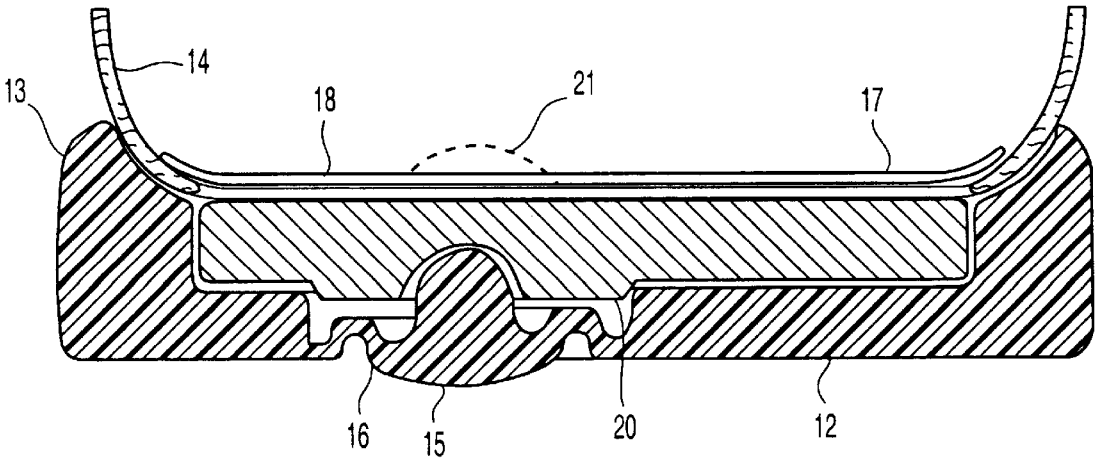
FIG. 2 is a vertical section taken on the line I—I of FIG. 1 showing a first embodiment of a sole for therapeutic footwear according to the present invention.

FIG. 2 is a vertical section taken on the lines I—I of FIG. 1 showing a first embodiment of a sole which achieves this effect of selective pressure and impact on the area 4.

The sole 12 which is produced, for example, by moulding from rubber, constitutes an outer sole edged by a body portion 13 for connection and anchorage to the upper 14 by stitching and/or by gluing, a rubber pressure element 15 being formed integrally with the outer sole and connected thereto by means of a resilient bellows 16, also made of rubber and integral with the outer sole.

In the unstressed condition, the pressure element 15 extends below the plane of the outer sole by a suitable distance, for example 1–2 mm, and its top bears against a highly resilient midsole 17, for example, made of silicone rubber, housed in the body portion and interposed between the sole 12 and a thin, flat insole 18 which is also composite and is connected to the upper, no providing a comfortable bed for the foot.

To ensure that the pressure element 15 is positioned correctly even in the presence of tangential stresses, the pressure element 15 extends inside the sole in a suitable recess 19 formed in the midsole and surrounded by a projecting boss 20 which in turn is housed in a suitable recess in the sole 12.

The sole 12 and the midsole 17 may advantageously be coupled by gluing to provide, with the bellows 16, a double waterproof protection for the inside of the footwear.

When the sole is pressed against a bearing surface by the weight exerted on the insole, the pressure element 15 is forced inwards relative to the sole, exerting a local pressure on the midsole which deforms, causing the development of a projection, represented by the broken line 21, on the face of the insole 18 which is in contact with the foot.

This projection exerts pressure locally on the sole of the foot.

Clearly, a plurality of pressure elements consistent with the space occupied by the bellows such as 26 may be formed in the sole, possibly with cross-sections of different widths, for jointly bringing about pressure-stimulation of a plurality of areas of the sole of the foot and for achieving therapeutic effects in various organs, or even synergic effects.

By virtue of its peripheral body portion, the sole of FIG. 2 is particularly suitable for sports footwear and many variants are possible.

Figure 3:
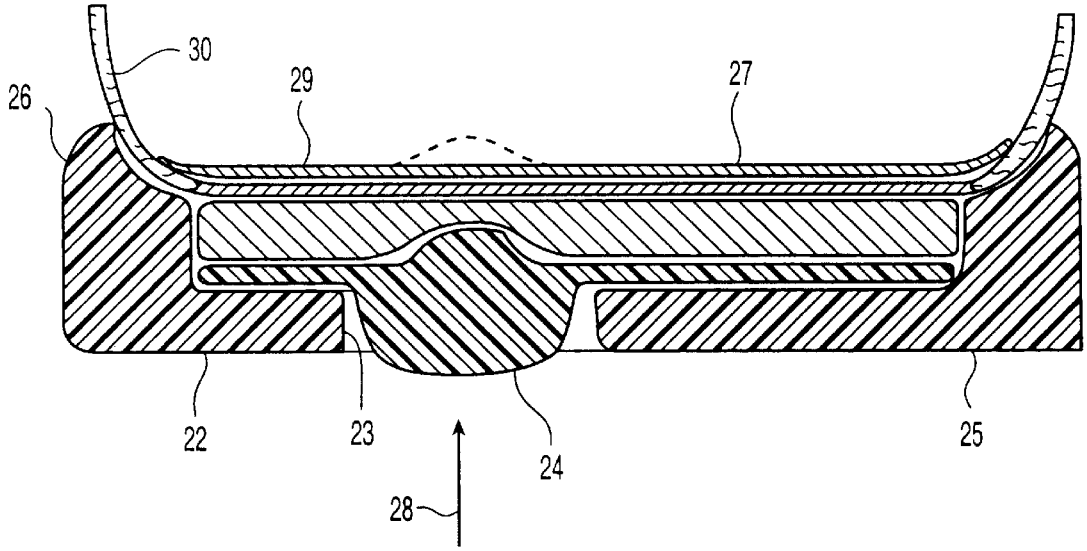
FIG. 3 is a vertical section taken on the line I—I of FIG. 1 showing a second embodiment of a sole for therapeutic footwear according to the present invention.

For example, as shown in FIG. 3, a sole with the same functionality can be produced as a combination of anouter sole 22 of injected expanded polyurethane or of other suitable known materials having at least one but preferably more than one hole 23 for housing a pressure element 24 produced by moulding integrally with a rubber sheet 25 which may also include several pressure elements.

The rubber sheet 25 is glued to the upper or inner face of the outer sole 22 and, advantageously, is housed inside any peripheral body portion 26 of the outer sole.

Alternatively, the outer sole 22 and the sheet 25 with the respective pressure element (or elements) may be connected without gluing, by a double moulding operation, the rubber sheet being formed first and the sheet thus formed then being used as an insert for a subsequent operation to mould the outer sole.

With regard to the characteristics of the materials used and to the temperatures necessary for the two moulding processes, the process may also be carried out in reverse order with the preliminary formation of the outer sole and the subsequent formation of the sheet with the pressure elements.

In any case, with the sole thus assembled, the dimensions of the pressure element or elements are advantageously such that, in the absence of stresses, the pressure element or elements extend below the surface of the outer sole by a suitable distance.

A soft pad 27 of foam rubber is superimposed on the rubber sheet 25 in order to provide a highly resilient spacer into which the pressure element 24 can sink when it is urged in the direction indicated by the arrow 28 from the exterior.

Advantageously, the pressure element 24 as shown may also extend into the thickness of the pad in the rest condition, preloading it resiliently and reducing the thickness separating the inner end of the pressure element from a soft insole 29 of the footwear superimposed on the pad and connected to an upper 30.

Alternatively, the pad may be premoulded with recesses for housing the inner end of the pressure element.

Figure 4:
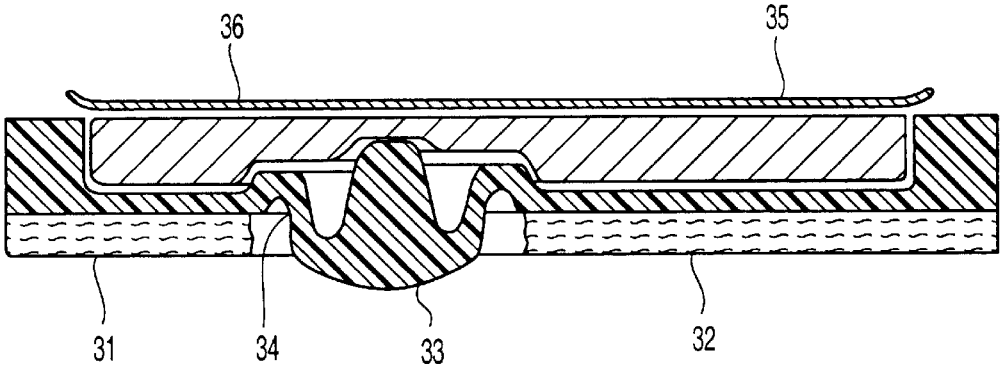
FIG. 4 is a vertical section taken on the line I—I of FIG. 1 showing a third embodiment of a sole for therapeutic footwear according to the present invention.

As shown in FIG. 4 soles for "town" footwear and not necessarily for sports footwear may also be produced for wear during normal activities and not only during activities directed specifically towards the achievement of the therapeutic effect.

For example, in FIG. 4, the sole is constituted by a leather outer sole 31 connected by gluing or injection-moulding to a sheet 32 of resilient material such as plasticized PVC or similar plastics material (TR) with good resilience, formed with one or more integral pressure elements 33 connected to the sheet 32 by means of bellows-like mouldings 34 formed integrally with the sheet 32.

The pressure element or elements 33 in this embodiment also extend below the surface of the outer sole by a suitable distance in the unstressed condition.

For this purpose, the outer sole has suitable holes for housing the pressure element (or elements) and at least a portion of the bellows-like moulding 34.

The pressure elements, such as 33, extend through the entire thickness of the sole in order, when stressed, to press against predetermined areas of the sole of the user's foot with their upper ends, through a resilient pad 33 and a soft insole 36.

A sole thus formed can be connected to an upper in conventional manner, preferably by stitching, so as to form a therapeutic shoe.

It is also envisaged that the areas 4–11 may bear imprints 37, for example, numerical indications such as those shown in FIG. 1, which indicate the specific areas so that the user can recognize the therapeutic effect by means of a table (not shown), provided with the footwear. By way of explanation, the table could, for example, give the number of each area with, beside it, an indication of the organ stimulated; for the area 4, indicated by the reference numeral 1, activation of the circulation and stimulation of the mobility of the cervical vertebrae; for the area 9, indicated by the reference numeral 6, stimulation of lung activity.

What is claimed is:

1. A sole for footwear comprising at least one pressure element disposed in the sole for movement perpendicularly relative to an outer surface of the sole, said at least one pressure element extending through the thickness of the sole and having a lower end which, in the absence of stress, extends below the surface of the sole by a predetermined distance, a resilient intermediate element comprising a soft inner sole of the footwear disposed in engagement with an upper end of the at least one pressure element whereby when the sole is pressed against a bearing surface, the at least one pressure element will exert a pressure on a selected portion of a foot sole through the resilient intermediate element.

2. A sole according to claim 1, comprising a plurality of pressure elements (15; 24; 33).

3. A sole according to claim 1, wherein the sole comprises an outer sole (12; 31) of resilient material, the at least one pressure element (15; 33) being formed integrally with the outer sole to which it is connected by means of a resilient bellows (16; 34) so as to be movable perpendicularly relative to the outer surface of the outer sole.

4. A sole according to claim 3, in which the inner sole has a seat for housing the upper end of the at least one pressure element (15; 24; 33).

5. A sole according to claim 1, comprising an outer sole (22) with at least one hole (23) for housing the at least one pressure element (24), and a sheet of resilient material (25) moulded integrally with the at least one pressure element (24) and connected to the outer sole (22) by gluing to the inner face of the outer sole.

6. A sole according to claim 1, comprising an outer sole (22) with at least one hole (23) for housing the at least one pressure element (24) and a sheet of resilient material (25) moulded integrally with the at least one pressure element (24) and connected to the inner face of the outer sole (22) by moulding.

7. A sole according to claim 1, further comprising a leather outer sole (31) with at least one hole for housing the at least one pressure element (33) and a sheet of resilient material (34) moulded integrally with the at least one pressure element (33) and connected to an inner surface of the leather outer sole (31).

8. Therapeutic footwear comprising an upper (14) and a sole according to claim 1.

9. Therapeutic footwear according to claim 8, in which the upper (14) is stitched to the sole (12).

* * * * *